US008181467B2

(12) United States Patent
Kumar et al.

(10) Patent No.: US 8,181,467 B2
(45) Date of Patent: May 22, 2012

(54) MID-TURBINE FRAME TORQUE BOX HAVING A CONCAVE SURFACE

(75) Inventors: Keshava B. Kumar, South Windsor, CT (US); Nagendra Somanath, Manchester, CT (US); William A. Sowa, Simsbury, CT (US)

(73) Assignee: United Technologies Corporation, Hartford, CT (US)

( * ) Notice: Subject to any disclaimer, the term of this patent is extended or adjusted under 35 U.S.C. 154(b) by 254 days.

(21) Appl. No.: 12/824,903

(22) Filed: Jun. 28, 2010

(65) Prior Publication Data

US 2011/0030387 A1 Feb. 10, 2011

Related U.S. Application Data

(62) Division of application No. 11/397,157, filed on Apr. 4, 2006, now Pat. No. 7,775,049.

(51) Int. Cl.
*F02C 7/20* (2006.01)

(52) U.S. Cl. ..... 60/796; 415/142

(58) Field of Classification Search ..... 60/796, 60/797, 805; 415/142, 229, 231.1, 191, 208.2, 415/209.2, 209.4, 210.1
See application file for complete search history.

(56) References Cited

U.S. PATENT DOCUMENTS

| | | | | |
|---|---|---|---|---|
| 3,540,682 | A * | 11/1970 | Ferguson et al. | 244/53 R |
| 3,620,641 | A | 11/1971 | Keen et al. | |
| 4,428,713 | A | 1/1984 | Coplin et al. | |
| 4,920,742 | A * | 5/1990 | Nash et al. | 60/799 |
| 6,708,482 | B2 | 3/2004 | Seda | |
| 6,883,303 | B1 | 4/2005 | Seda | |
| 2006/0093465 | A1 * | 5/2006 | Moniz et al. | 415/68 |
| 2008/0031727 | A1 | 2/2008 | Sjoqvist | |

* cited by examiner

*Primary Examiner* — Ehud Gartenberg
*Assistant Examiner* — Andrew Nguyen
(74) *Attorney, Agent, or Firm* — Kinney & Lange, P.A.

(57) ABSTRACT

A single point load structure transfers a first load from a first bearing cone and a second load from a second bearing cone of a gas turbine engine to a plurality of struts. The single point load structure includes a stem, a branch connected to the stem and a torque box connected to the plurality of struts for absorbing the first and second loads from the stem and the branch. The stem has a concave surface that opens in a radially outward direction with respect to a rotational axis of the gas turbine engine.

4 Claims, 7 Drawing Sheets

MID-TURBINE FRAME TORQUE BOX HAVING A CONCAVE SURFACE

CROSS-REFERENCE TO RELATED APPLICATION(S)

This is a divisional of U.S. patent application Ser. No. 11/397,157, entitled "INTEGRATED STRUT DESIGN FOR MID-TURBINE FRAMES WITH U-BASE," filed Apr. 4, 2006 by Keshava B. Kumar et al, the disclosure of which is incorporated by reference in its entirety. Reference is also made to application Ser. No. 12/824,884 entitled "MID-TURBINE FRAME" which is a continuation of U.S. patent application Ser. No. 11/397,157, and is filed on even date and is assigned to the same assignee as this application.

BACKGROUND

The present invention generally relates to the field of gas turbine engines. In particular, the invention relates to a mid-turbine frame for a jet turbine engine.

Turbofans are a type of gas turbine engine commonly used in aircraft, such as jets. The turbofan generally includes a high and a low pressure compressor, a high and a low pressure turbine, a high pressure rotatable shaft, a low pressure rotatable shaft, a fan, and a combuster. The high-pressure compressor (HPC) is connected to the high pressure turbine (HPT) by the high pressure rotatable shaft, together acting as a high pressure system Likewise, the low pressure compressor (LPC) is connected to the low pressure turbine (LPT) by the low pressure rotatable shaft, together acting as a low pressure system. The low pressure rotatable shaft is housed within the high pressure shaft and is connected to the fan such that the HPC, HPT, LPC, LPT, and high and low pressure shafts are coaxially aligned.

Outside air is drawn into the jet turbine engine by the fan and the HPC, which increases the pressure of the air drawn into the system. The high-pressure air then enters the combuster, which burns fuel and emits the exhaust gases. The HPT directly drives the HPC using the fuel by rotating the high pressure shaft. The LPT uses the exhaust generated in the combuster to turn the low pressure shaft, which powers the fan to continually bring air into the system. The air brought in by the fan bypasses the HPT and LPT and acts to increase the engine's thrust, driving the jet forward.

In order to support the high and low pressure systems, bearings are located within the jet turbine engine to help distribute the load created by the high and low pressure systems. The bearings are connected to a mid-turbine frame located between the HPT and the LPT by bearing support structures, for example, bearing cones. The mid-turbine frame acts to distribute the load on the bearing support structures by transferring the load from the bearing support structures to the engine casing. Decreasing the weight of the mid-turbine frame can significantly increase the efficiency of the jet turbine engine and the jet itself.

SUMMARY

A single point load structure transfers a first load from a first bearing cone and a second load from a second bearing cone of a gas turbine engine to a plurality of struts. The single point load structure includes a stem, a branch connected to the stem and a torque box connected to the plurality of struts for absorbing the first and second loads from the stem and the branch. The stem has a concave surface that opens in a radially outward direction with respect to a rotational axis of the gas turbine engine.

DETAILED DESCRIPTION

Figure 1:
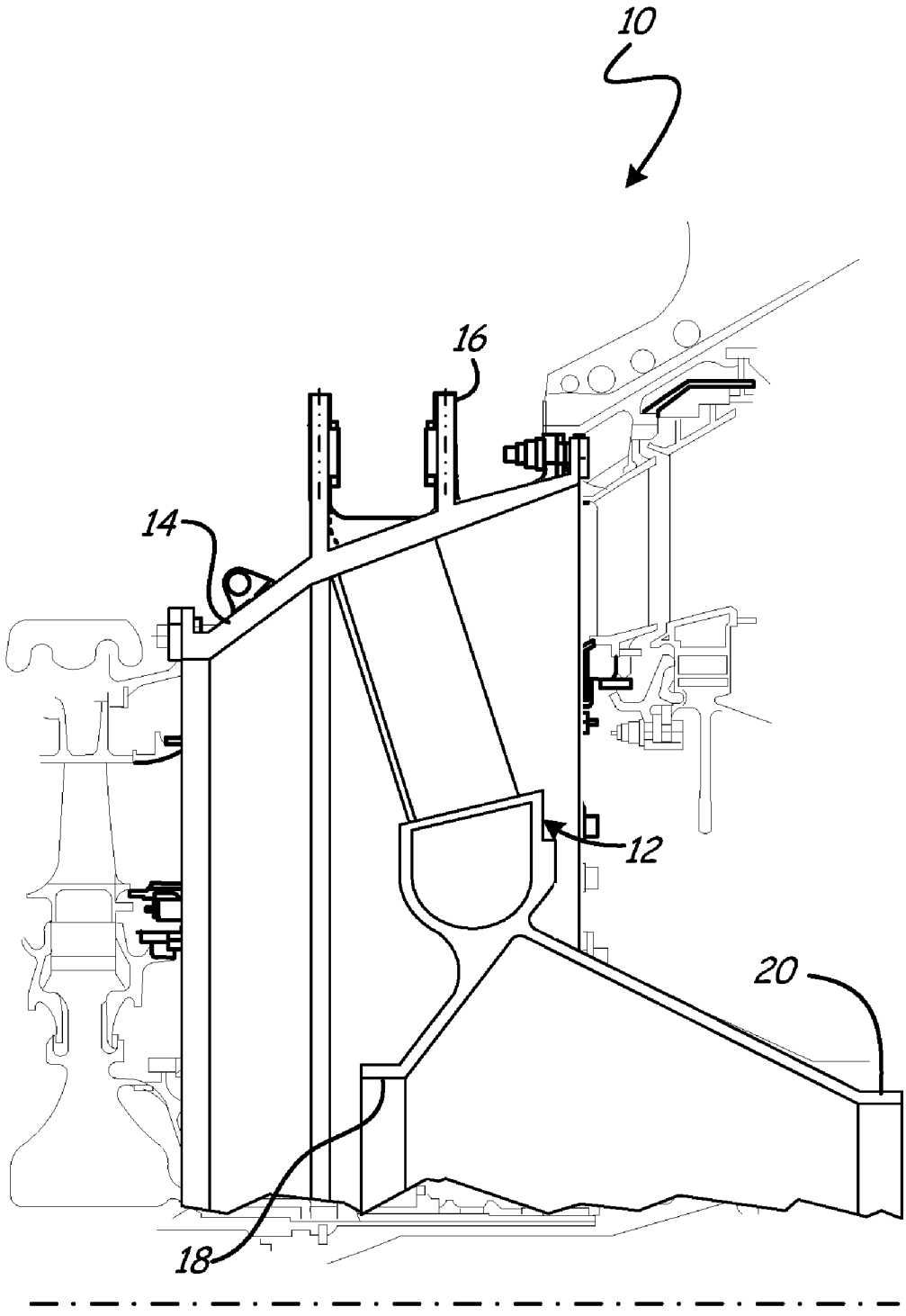
FIG. 1 is a partial sectional view of a gas turbine engine having a mid-turbine frame.

FIG. 1 shows a partial sectional view of an intermediate portion of gas turbine engine 10 about a gas turbine engine axis centerline. Gas turbine engine 10 generally includes mid-turbine frame 12, engine casing 14, mounts 16, first bearing 18, and second bearing 20. Mid-turbine frame 12 of gas turbine engine 10 has a lightweight design that transfers the loads from first and second bearings 18 and 20 to a single point load. The design of mid-turbine frame 12 is also capable of withstanding a large amount of load without deflecting, increasing its structural efficiency.

Mid-turbine frame 12 is housed within engine casing 14 of gas turbine engine 10. Mid-turbine frame 12 is connected to engine casing 14 and first and second bearings 18 and 20. Engine casing 14 protects mid-turbine frame 12 from its surroundings and transfers the loads from mid-turbine frame 12 to mounts 16. Mid-turbine frame 12 is designed to combine the loads from first and second bearings 18 and 20 to one point for a single point load transfer. Due to the design of mid-turbine frame 12, mid-turbine frame 12 has reduced weight. The weight of mid-turbine frame 12 will depend on the material used to form mid-turbine frame 12. In one embodiment, mid-turbine frame 12 has a weight of less than approximately 200 pounds. For example, mid-turbine frame 12 formed of a Nickel-based alloy has a weight of approximately 175 pounds. Mid-turbine frame 12 is also designed as a functional plenum and does not require an independent heat transfer plenum. In addition, mid-turbine frame 12 can be integrally cast as one piece with a cooling air redistribution device as an integral component.

First and second bearings 18 and 20 are located at forward and aft ends of gas turbine engine 10, respectively, below mid-turbine frame 12. First and second bearings 18 and 20 support thrust loads, vertical tension, side gyroscopic loads, as well as vibratory loads from high and low pressure rotors located in gas turbine engine 10. All of the loads supported by first and second bearings 18 and 20 are transferred to engine casing 14 and mounts 16 through mid-turbine frame 12. Second bearing 20 is typically designed to support a greater load than first bearing 18, so mid-turbine frame 12 is designed for stiffness and structural feasibility assuming that second bearing 20 is the extreme situation.

Figure 2:
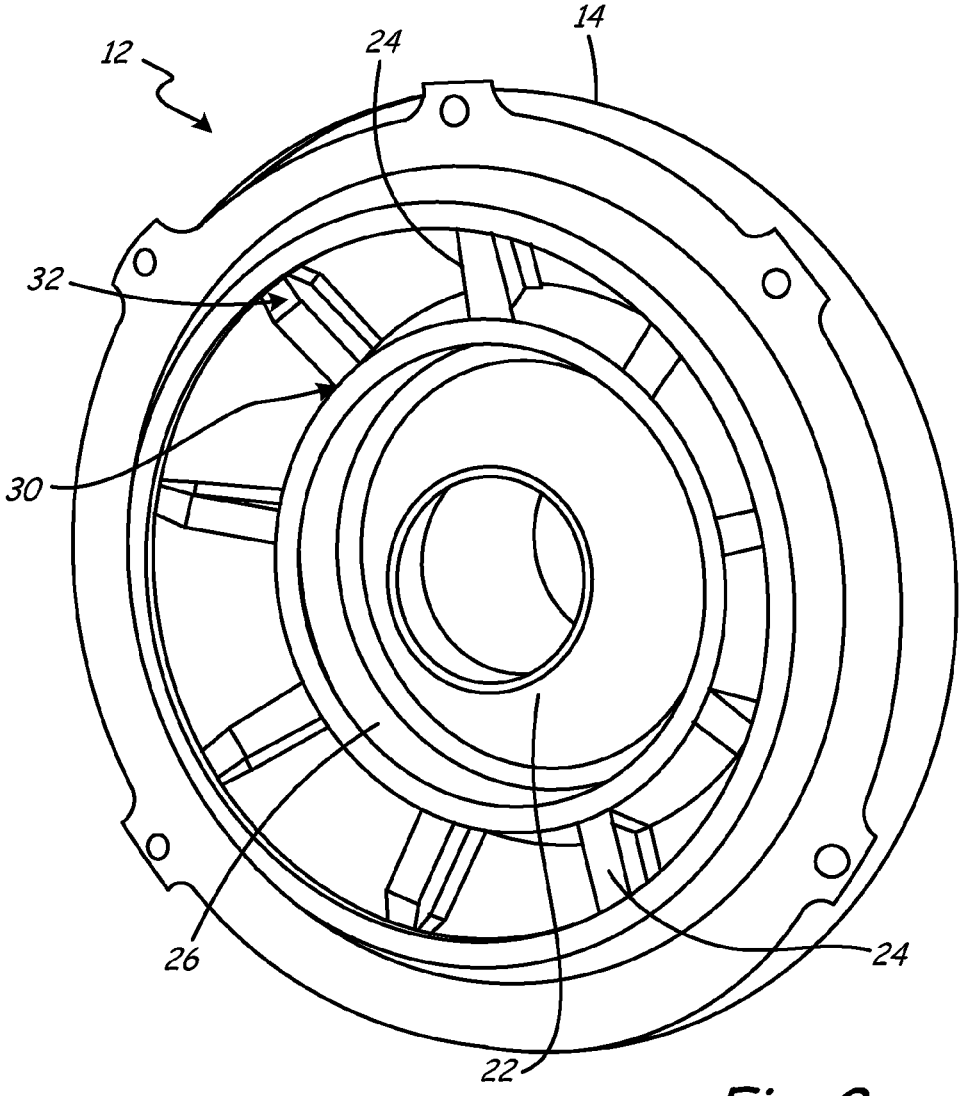
FIG. 2 is a perspective view of the mid-turbine frame.

FIG. 2 shows an enlarged, perspective view of mid-turbine frame 12 within a cross-section of engine casing 14. Mid-turbine frame 12 generally includes torque box 22 and struts 24. First and second bearings 18 and 20 (shown in FIG. 1) are connected to mid-turbine frame 12 by first bearing cone 26 and second bearing cone 28 (shown in FIG. 1), respectively. First and second bearings cones 26 and 28 are continuously rotating with high and low pressure rotors and transfer the loads from first and second bearings 18 and 20 to mid-turbine frame 12.

Torque box 22 has a shell structure and is positioned between first and second bearing cones 26 and 28 and struts 24. Torque box 22 takes the loads, or torque, from first and second bearing cones 26 and 28 and combines them prior to transferring the loads to struts 24, which extend from along the circumference of torque box 22.

Struts 24 of mid-turbine frame 12 transfer the loads from first and second bearing cones 26 and 28 entering through torque box 22 to engine casing 14. Each of struts 24 has a first end 30 connected to torque box 22 and a second end 32 connected to engine casing 14. The loads travel from torque box 22 through struts 24 to engine casing 14. In one embodiment, struts 24 have an elliptical shape and are sized to take a load and transfer it in a vertical direction toward engine casing 14. In one embodiment, nine struts are positioned approximately forty degrees apart from one another along the circumference of torque box 22. In another embodiment, twelve total struts are positioned approximately thirty degrees apart from one another along the circumference of torque box 22.

Figure 3A:
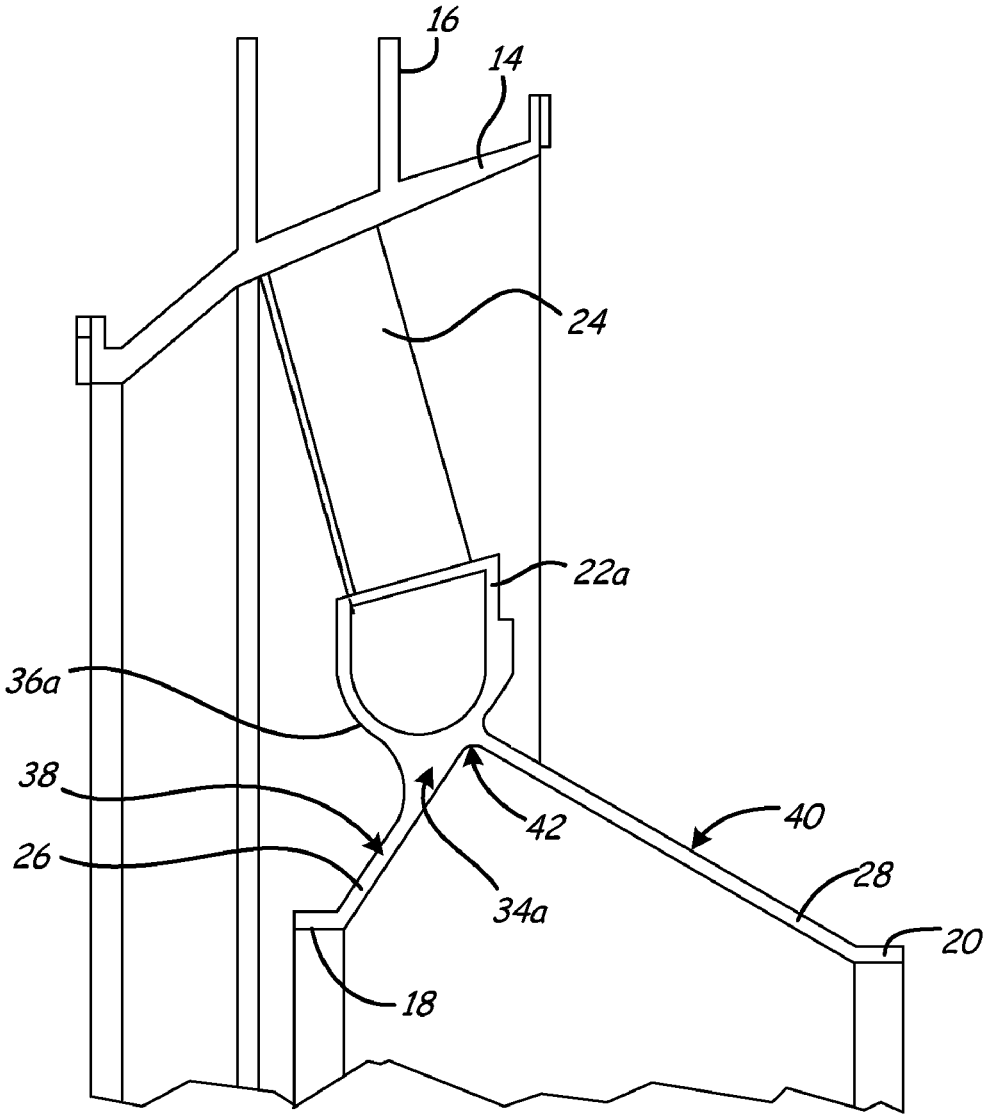
FIG. 3A is a cross-sectional view of a first embodiment of the med-turbine frame.
Figure 3B:
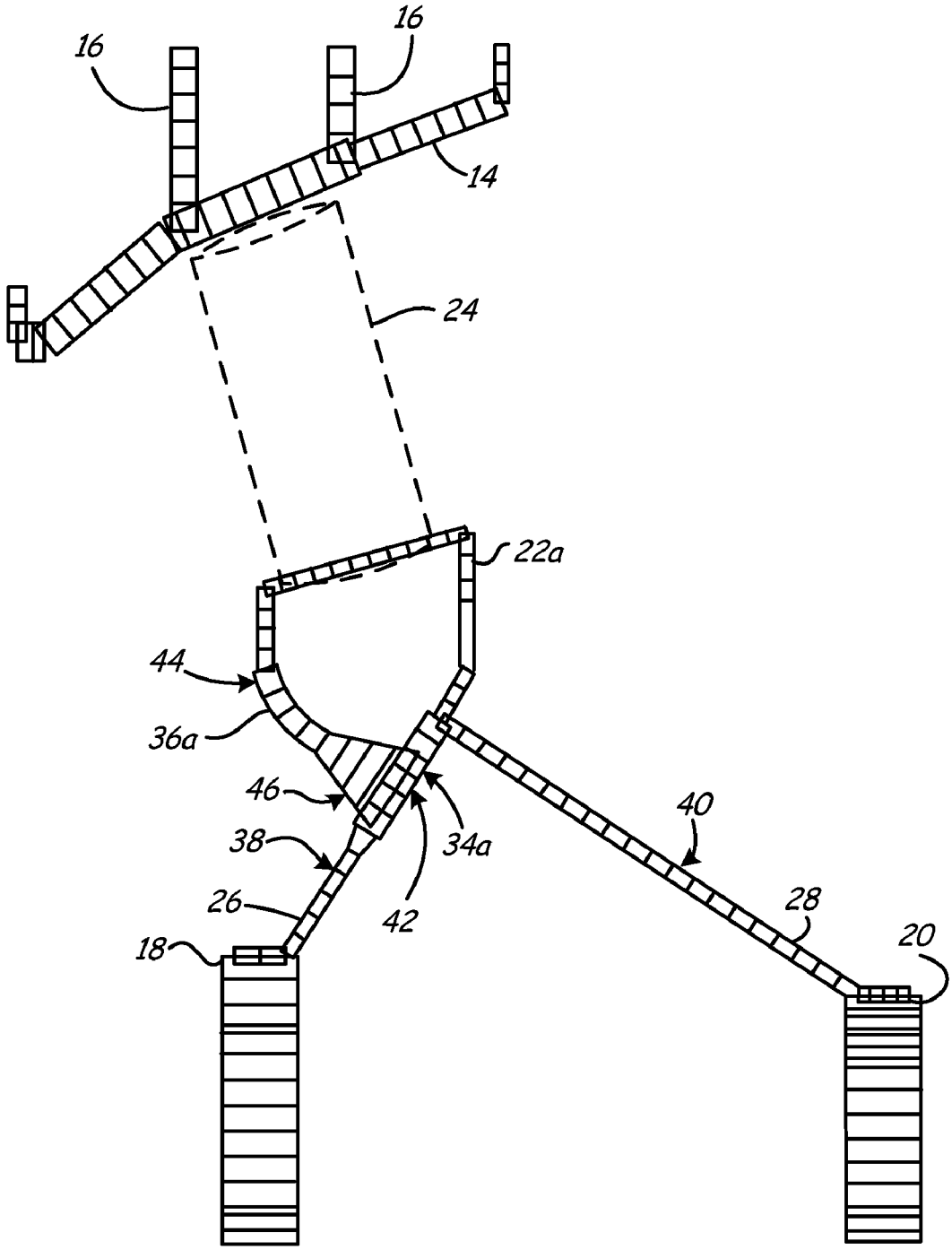
FIG. 3B is a schematic diagram of the first embodiment of the mid-turbine frame.

FIGS. 3A and 3B show a cross-sectional view and a schematic diagram of a first embodiment of torque box 22*a*, respectively, and will be discussed in conjunction with one another. Torque box 22*a* is U-shaped and generally includes U-stem 34*a* and U-branch 36*a*. U-stem 34*a* of mid-turbine frame 12 has a first portion 38, a second portion 40, and a U-shaped center portion 42. U-stem 34*a* is positioned below torque box 22 and connects first and second bearing cones 26 and 28 to each other as well as to torque box 22*a*. First portion 38 of U-stem 34*a* extends from center portion 42 towards first bearing 18 and also functions as first bearing cone 26. Second portion 40 of U-stem 34*a* extends from center portion 42 towards second bearing 20 and also functions as second bearing cone 28. First and second bearing cones 26 and 28 are thus part of U-stem 34*a* and merge together at center portion 42. The loads of first and second bearing cones 26 and 28 are introduced into torque box 22*a* at center portion 42 U-stem 34*a*. Due to the shell shape of U-stem 34*a*, mid-turbine frame 12 can handle large loads at a time without deflecting. U-stem 34*a* also acts as a protective heat shield and provides thermal protection to torque box 22*a*.

U-branch 36*a* has a first end 44 and a second end 46. First end 44 of U-branch is connected to torque box 22*a* and second end 46 of U-branch 36*a* is connected to U-stem 34*a* at center portion 42 of U-stem 34*a*. By connecting U-branch 36*a* to center portion 42 of U-stem 34*a*, U-branch 36*a* can function as a bearing arm load transfer member.

Figure 4:
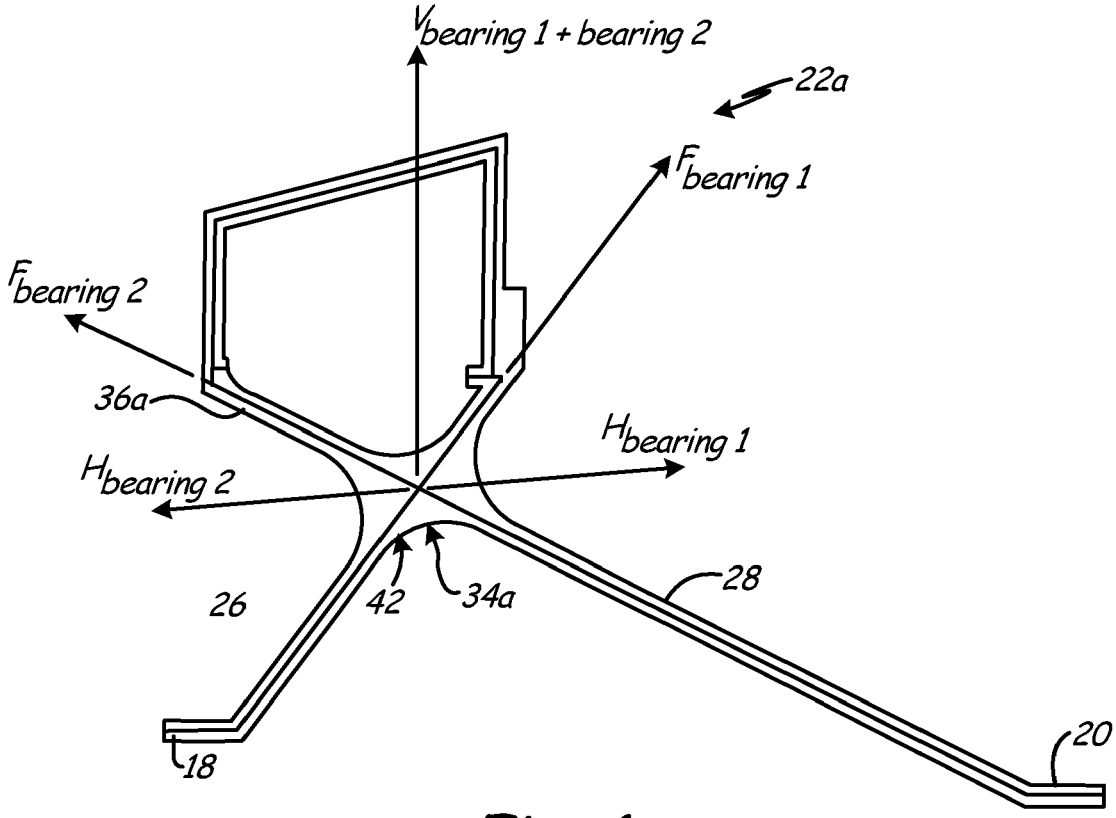
FIG. 4 is a free body diagram of the first embodiment of the mid-turbine frame.

FIG. 4 is a free body diagram of torque box 22*a* connected to first and second bearings 18 and 20. The loads, or reaction forces, from first and second bearings 18 and 20 come through first and second bearing cones 26 and 28, Fbearing1 and Fbearing2, respectively. Reaction forces Fbearing1 and Fbearing2 come in at an angle and intersect at U-stem 34*a*. The reaction forces are then broken up into simple vectors with horizontal components Hbearing1 and Hbearing2 and vertical components Vbearing1 and Vbearing2. The horizontal components Hbearing1 and Hbearing2 come in at opposite directions and cancel each other out a center portion 42 of U-stem 34*a*. Because the horizontal components Hbearing1 and Hbearing2 cancel each other out, only the vertical components Vbearing1+bearing2 are transferred through U-stem 34*a* and U-branch 36*a* to torque box 22*a*. The total load is thus reduced due to the absorptive components being cancelled at center portion 42 of U-stem 34*a*.

Figure 5A:
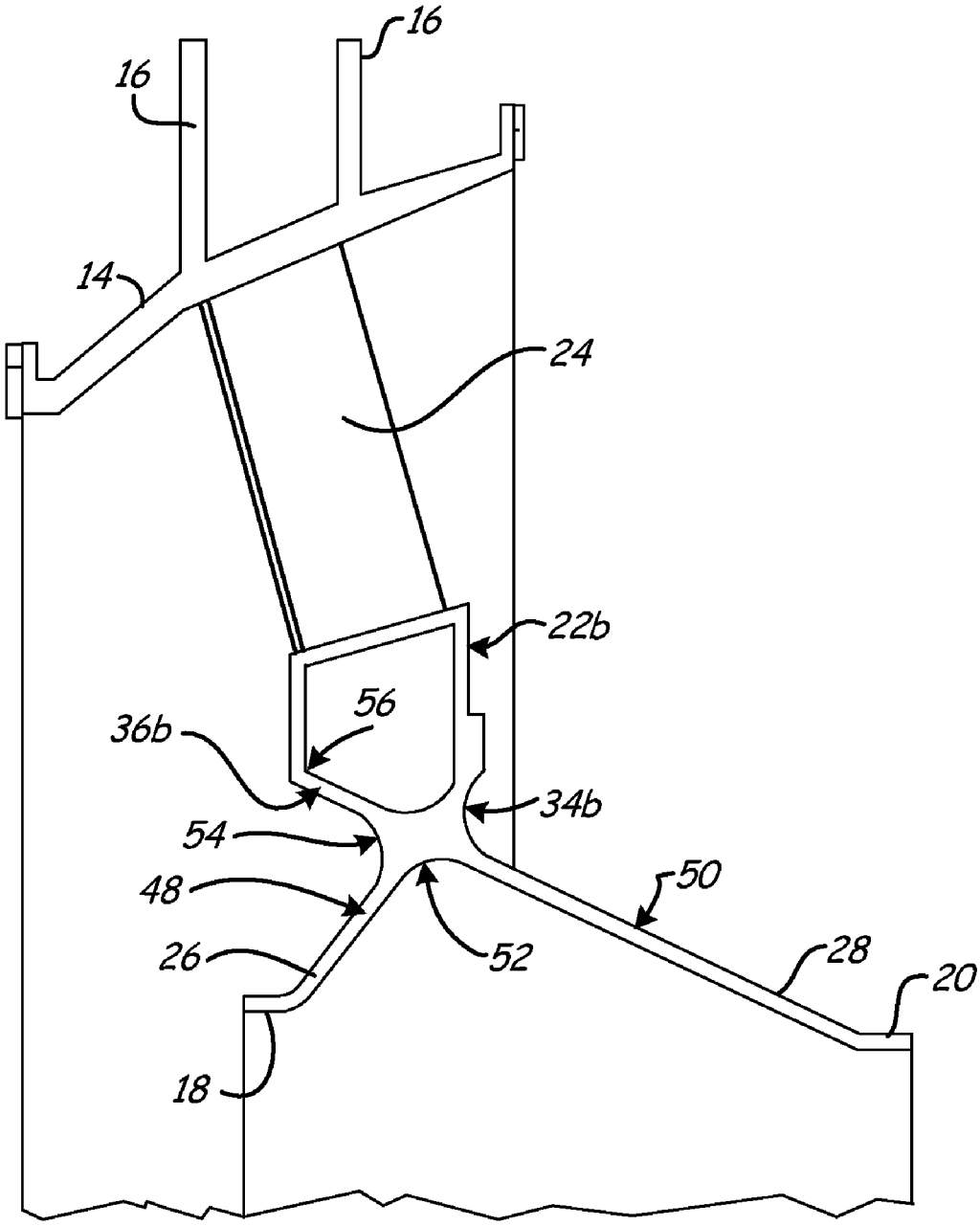
FIG. 5A is a cross-sectional view of a second embodiment of the mid-turbine frame.
Figure 5B:
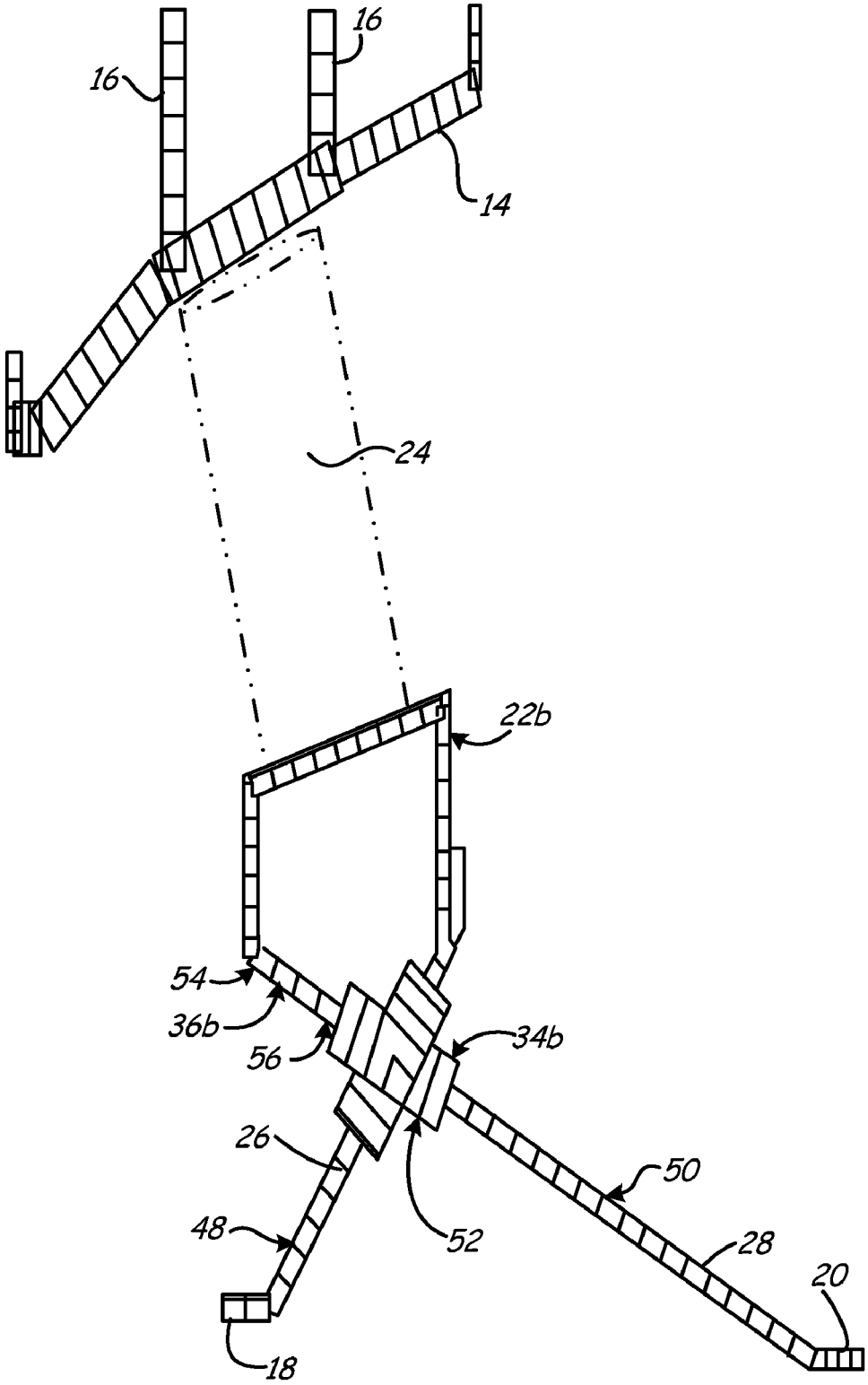
FIG. 5B is a schematic diagram of the second embodiment of the mid-turbine frame.

FIGS. 5A and 5B show a cross-sectional view and a schematic diagram of a second embodiment of torque box 22*b*, respectively, and will be discussed in conjunction with one another. Torque box 22*b* is X-shaped and generally includes X-stem 34*b* and X-branch 36*b*. Similar to torque box 22*a*, first and second bearings 18 and 20 are connected to X-shaped mid-turbine frame 22*b* by first and second bearing cones 26 and 28, respectively. The loads from first and second bearings 18 and 20 travel through first and second bearing cones 26 and 28 respectively, and are transferred to torque box 22*b*. Torque box 22*b* then transfers the load to engine casing 14 and mounts 16.

X-stem 34*b* of torque box 22*b* has a first portion 48, a second portion 50, and an X-shaped center portion 52. X-stem 34*b* is positioned below torque box 22*b* and connects first and second bearing cones 26 and 28 to each other as well as to torque box 22*b*. First portion 48 of X-stem 34*b* extends from center portion 52 towards first bearing 18 and also functions as first bearing cone 26. Second portion 50 of U-stem 34*b* extends from center portion 52 towards second bearing 20 and also functions as second bearing cone 28. First and second bearing cones 26 and 28 are thus part of X-stem 34*b* and merge together at center portion 52. X-stem 34*b* acts as a protective heat shield and provides thermal protection to torque box 22*b*. The loads of first and second bearing cones 26 and 28 are also introduced into torque box 22*b* at X-stem 34*b*.

X-branch 36*b* has a first end 54 and a second end 56. First end 54 of X-branch 36*b* is connected to torque box 22*b* and second end 56 of X-branch 36*b* is connected to X-stem 34*b* at center portion 52 of X-stem 34*b*. By connecting X-branch 36*b* to center portion 52 of X-stem 34*b*, X-branch 36*b* can function as a bearing arm load transfer member.

In operation, X-stem 34*b* of torque box 22*b* functions similarly to U-stem 34*a* of torque box 22*a* except that due to the X-shape of center portion 52, there is a scissor action that causes an additional load and local state of stress at center portion 52. Thus, while torque box 22*b* also has increased structural efficiency, the amount of load that torque box 22*b* can support before deflecting will be less than the amount of load that torque box 22*a* can support.

The torque box designs of the mid-turbine frame offer a lightweight structure with increased structural efficiency. The torque box has a single point transfer structure that delivers the loads from a first second bearing in the gas turbine engine. The single point transfer structure thus functions partly as a first and a second bearing cone. The loads from the first and second bearings combine at the single point transfer structure to a single load transfer point. Because the loads from the first and second bearings enter the single point transfer structure at an angle, the horizontal components of the loads cancel each other out. The only remaining force is in the vertical direction. The loads are combined and transferred to the torque box, which subsequently transfers the loads to a plurality of struts attached to the torque box. The struts are attached to an engine casing surrounding the mid-turbine frame, and delivers the load from the torque box to the engine casing. In one embodiment, the single point transfer structure has a U-shape. In another embodiment, the single point transfer structure has an X-shape.

Although the present invention has been described with reference to preferred embodiments, workers skilled in the art will recognize that changes may be made in form and detail without departing from the spirit and scope of the invention.

The invention claimed is:

1. A single point load structure for transferring a first load from a first bearing cone and a second load from a second bearing cone of a gas turbine engine to a plurality of struts, the single point load structure comprising:

a stem for combining the first and second loads from the first and second bearing cones, the stem having a concave surface that opens in a radially outward direction with respect to a rotational axis of the gas turbine engine, wherein the stem is U-shaped;

a branch connected to the stem for absorbing a portion of the first and second loads from the first and second bearing cones; and a torque box connected to the plurality of struts for transferring the combined load from the stem and branch to the plurality of struts, wherein the torque box further comprises a first member and a second member both perpendicular to the rotational axis of the gas turbine engine for transferring the combined load from the concave surface of the stem, wherein the first and second members are joined by the concave surface, and wherein the structure is one integral piece.

2. The single point load structure of claim 1, wherein the first and second bearing cones are integrated with the stem.

3. The single point load structure of claim 1, wherein the torque box is a ring structure.

4. The single point load structure of claim 1, wherein the branch is connected to the stem at an angle between perpendicular to and parallel to the rotational axis of the gas turbine engine.

* * * * *